US009055803B2

(12) United States Patent
Purizhansky et al.

(10) Patent No.: US 9,055,803 B2
(45) Date of Patent: Jun. 16, 2015

(54) FOAM APPLICATOR FOR APPLYING A FLUID

(75) Inventors: Edward M. Purizhansky, Amherst, NY (US); Clint S. Winter, Holland, NY (US); Matthew S. Mantelli, Depew, NY (US)

(73) Assignee: TMP Technologies, Inc., Buffalo, NY (US)

( * ) Notice: Subject to any disclaimer, the term of this patent is extended or adjusted under 35 U.S.C. 154(b) by 879 days.

(21) Appl. No.: 13/187,110

(22) Filed: Jul. 20, 2011

(65) Prior Publication Data

US 2013/0022387 A1 Jan. 24, 2013

(51) Int. Cl.
*A45D 34/04* (2006.01)

(52) U.S. Cl.
CPC ..... *A45D 34/04* (2013.01); *A45D 2200/1018* (2013.01)

(58) Field of Classification Search
CPC ..... A45D 34/04; A45D 2200/1018
USPC ..... 401/139, 196, 202, 205, 206, 261–264, 401/266; 215/321
See application file for complete search history.

(56) References Cited

U.S. PATENT DOCUMENTS

| | | | |
|---|---|---|---|
| 1,217,054 | A | 2/1917 | Pearman |
| 2,185,575 | A | 1/1940 | Stinson et al. |
| 2,449,196 | A | 9/1946 | Bent |
| 2,962,743 | A | 12/1958 | Henriksson |
| 3,133,308 | A | 5/1964 | Claypool |
| 3,680,168 | A | 8/1972 | Krusche et al. |
| 4,035,090 | A | 7/1977 | Bavaveas |
| 4,133,614 | A | 1/1979 | Baginski et al. |
| 4,269,527 | A | 5/1981 | Lipfert et al. |
| 4,411,040 | A | 10/1983 | Sharrow et al. |
| 4,620,648 | A | 11/1986 | Schwartzman |
| 4,693,623 | A | 9/1987 | Schwartzman |
| 4,964,372 | A | 10/1990 | Zeenni et al. |
| 5,230,579 | A | 7/1993 | Klawson et al. |
| 5,246,139 | A | 9/1993 | Duceppe |
| D413,799 | S | 9/1999 | Schlatter |
| 6,183,154 | B1 | 2/2001 | Coe |
| D439,011 | S | 3/2001 | Linnette |
| D447,280 | S | 8/2001 | Angeletta |
| D449,707 | S | 10/2001 | Angeletta |

(Continued)

OTHER PUBLICATIONS

Dab-O-Matic Corp, "Product Showcase Dab-o-Matics", dated at least as early as Jul. 19, 2011, 1 page.

*Primary Examiner* — David Walczak
*Assistant Examiner* — Bradley Oliver
(74) *Attorney, Agent, or Firm* — Walter W. Duft

(57) ABSTRACT

A fluid applicator includes an applicator body, a foam element, and a fabric cover protecting the foam element. The applicator body includes a foam element support platform having first and second sides. A foam element engaging surface is provided on the first side of the foam element support platform. A foam element retaining wall is disposed at a peripheral edge of the foam element engaging surface. The foam element has a first side supported on the foam element engaging surface, a second side opposite the first side, and a peripheral edge at least partially enclosed by the retaining wall. A fabric mounting surface is disposed outside the retaining wall. The fabric cover is arranged on the second side of the foam element and is peripherally bonded to the fabric mounting surface. A fluid port provides fluid communication between the first side and second sides of the foam element support platform.

20 Claims, 7 Drawing Sheets

(56) References Cited

U.S. PATENT DOCUMENTS

| | | | | |
|---|---|---|---|---|
| D475,617 | S | 6/2003 | Angeletta | |
| D476,816 | S | 7/2003 | Angeletta | |
| D483,149 | S | 12/2003 | Angeletta | |
| D487,164 | S | 2/2004 | Denton | |
| 6,688,795 | B1 | 2/2004 | Jacob et al. | |
| 6,796,737 | B2 | 9/2004 | Ashe | |
| D505,749 | S | 5/2005 | Angeletta | |
| D506,027 | S | 6/2005 | Angeletta | |
| 6,932,532 | B2 | 8/2005 | Schwartzman et al. | |
| 7,165,692 | B2 * | 1/2007 | Konefal et al. | 215/220 |
| D547,003 | S | 7/2007 | Angeletta | |
| 8,025,453 | B2 * | 9/2011 | Chan | 401/202 |
| 2001/0031171 | A1 | 10/2001 | Delage | |
| 2003/0170067 | A1 | 9/2003 | Reggiani | |
| 2004/0120753 | A1 * | 6/2004 | Gieux | 401/200 |
| 2007/0189841 | A1 * | 8/2007 | Gueret | 401/266 |

* cited by examiner

FOAM APPLICATOR FOR APPLYING A FLUID

BACKGROUND

1. Field

The present disclosure relates to foam applicators for applying fluids to surfaces.

2. Description of the Prior Art

By way of background, there are many varieties of foam applicators for use in the application of fluid materials to surfaces. In such applicators, a foam element receives fluid from a fluid container and delivers the fluid to an application surface. The foam element is carried on a body portion of the applicator that typically mounts to the fluid container as an end cap. Although some foam applicators (e.g., finger-nail polish applicators) are designed for removal from the fluid container during use, other foam applicators (e.g., shoe polish applicators) are designed to remain on the fluid container. It is to improvements in the latter type of foam applicator that the present disclosure is directed. In particular, a foam applicator designed for applying fluids to irregular, rough or abrasive surfaces is disclosed.

SUMMARY

A fluid applicator according to an example embodiment includes an applicator body, a foam element, and a durable fabric cover to protect the foam element. The applicator body includes a foam element support platform having a first side and a second side. A foam element engaging surface is provided on the first side of the foam element support platform. A foam element retaining wall is disposed at a peripheral edge of the foam element engaging surface. The foam element has a first side supported on the foam element engaging surface, a second side opposite the first side, and a peripheral edge that is at least partially enclosed by the foam element retaining wall. A fabric mounting surface is disposed outside the foam element retaining wall. The fabric cover is arranged to cover the second side of the foam element and is peripherally bonded to the fabric mounting surface. A fluid port in the foam element support platform provides fluid communication between the first and second sides thereof.

In an example embodiment, the foam element may be unbonded to the foam element engaging surface and retained thereon solely by the fabric cover. The fabric cover may be bonded to the fabric mounting surface by a bond selected from the group consisting of heat-formed melt bonds, ultrasonic bonds and adhesive bonds. The foam element engaging surface may include a raised friction-enhancing structure, such as raised ridges, to help stabilize the foam element against lateral movement. To further stabilize the foam element, the foam element engaging surface may be recessed below the fabric mounting surface and the foam element retaining wall may extend beyond the fabric mounting surface. If desired, the foam element engaging surface may be configured as a circular area that is centrally disposed on the foam element support platform. The foam element retaining wall may be correspondingly configured as a ring-shaped structure that surrounds the foam element engaging surface, and the fabric mounting surface may be configured as an annular surface that surrounds the foam element retaining wall.

In an example embodiment, the fluid applicator may further include an applicator cap on the applicator body. In that case, the applicator body may include an applicator cap support structure that supports the applicator cap. The applicator body may also include one or more applicator cap retainer members that retain the applicator cap. The applicator cap support structure may include a peripheral cap-support ledge. Each applicator cap retainer member may be formed as a peripheral bump adjacent to the peripheral ledge. If desired, the cap-support ledge may be segmented to form one or more gap spaces in which the one or more applicator cap retainer members may be respectively disposed.

In an example embodiment, the fluid applicator may further including a first fluid container-engaging structure surrounding the fluid port on the second side of the foam element support platform. The fluid applicator may further include a fluid release valve disposed in the first fluid container-engaging structure. The fluid applicator may additionally include a second fluid container-engaging structure surrounding the first fluid container-engaging structure on the second side of the foam element support platform. The second fluid container-engaging structure may include one or more latch members operable to lockingly engage a fluid container.

BRIEF DESCRIPTION OF THE DRAWINGS

The foregoing and other features and advantages will be apparent from the following more particular description of an example embodiment, as illustrated in the accompanying Drawings, in which.

DETAILED DESCRIPTION OF EXAMPLE EMBODIMENT

Figure 1:
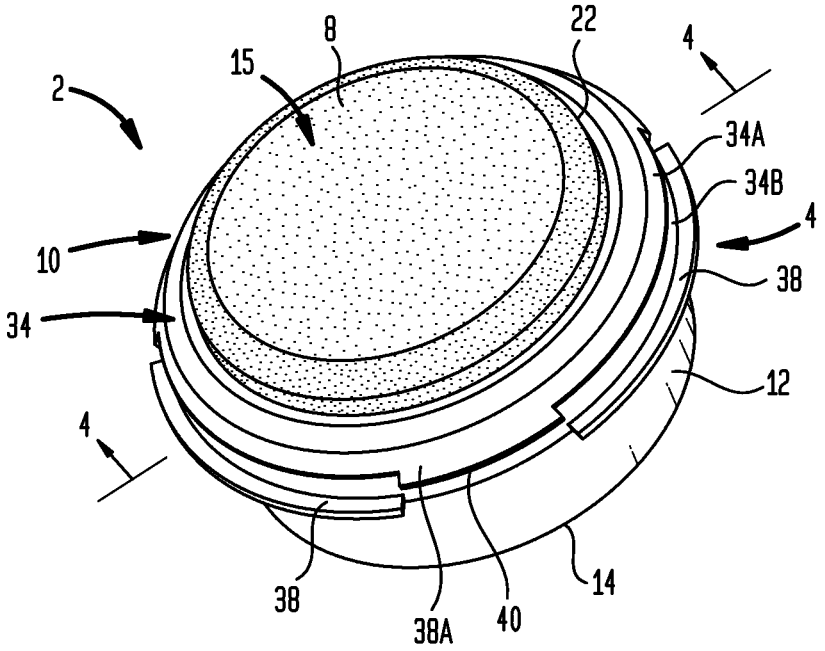
FIG. 1 is a perspective view showing the upper side of a fluid applicator constructed in accordance with the example embodiment.
Figure 2:
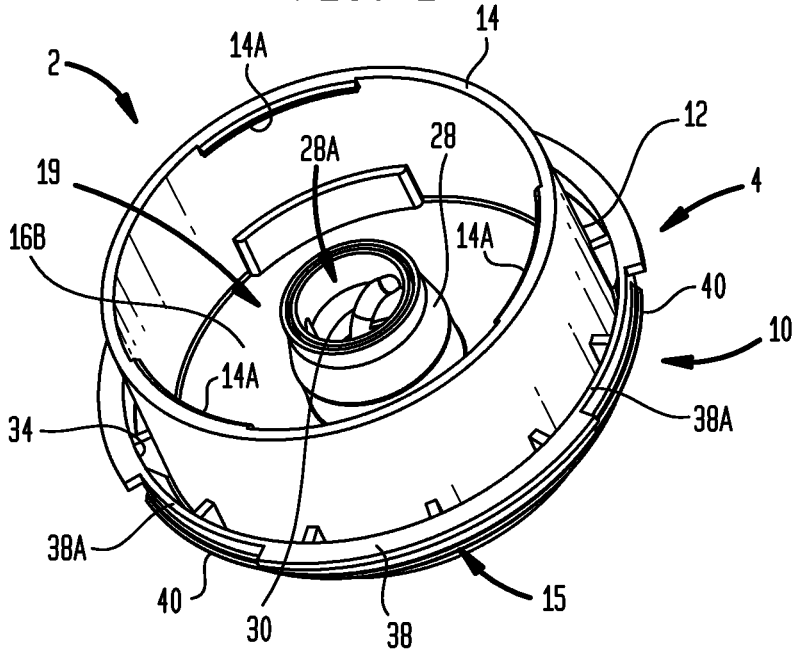
FIG. 2 is a perspective view showing the lower side of the fluid applicator of FIG. 1.
Figure 3:
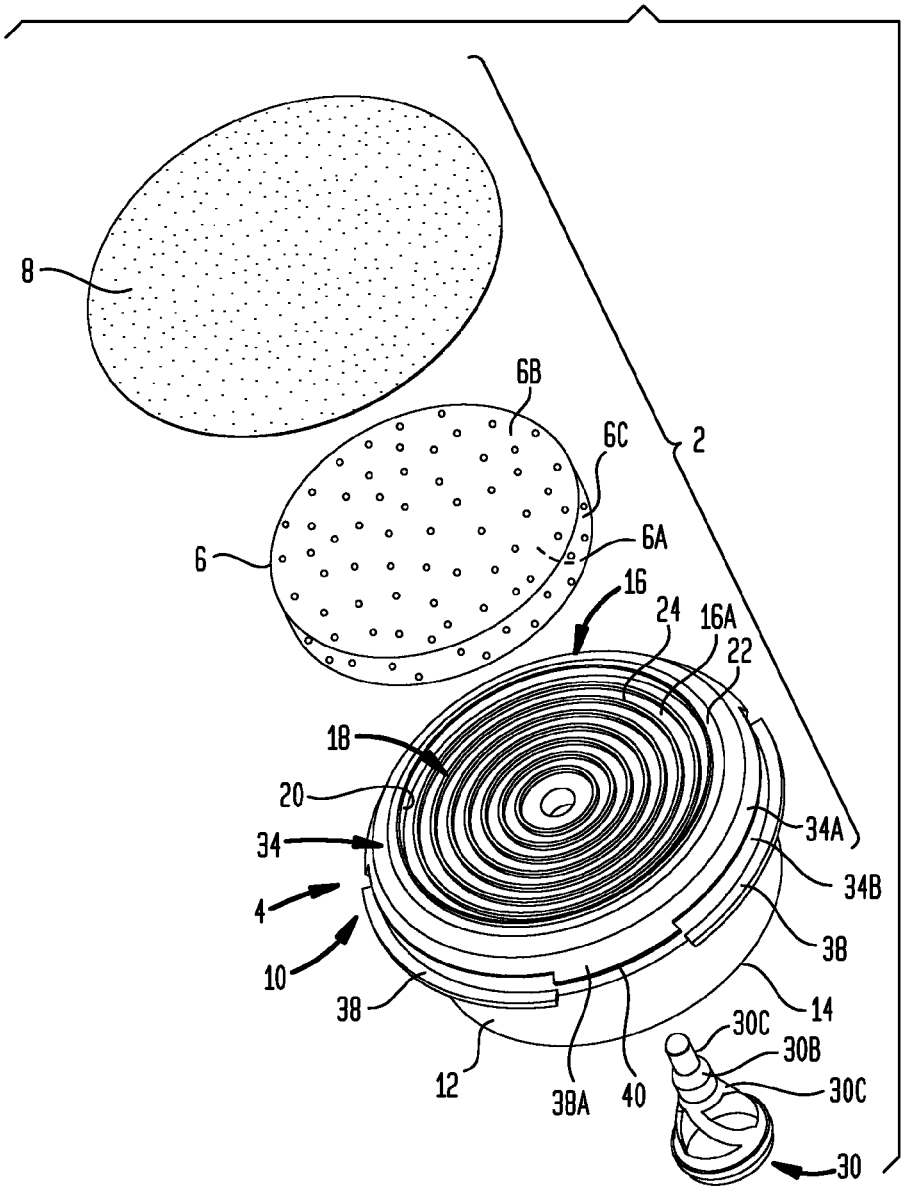
FIG. 3 is an exploded perspective view showing example components of the fluid applicator of FIG. 1.

Turning now to FIGS. 1-7B, a fluid applicator 2 constructed in accordance with an example embodiment is shown. As best shown in FIG. 3, the fluid applicator 2 includes an applicator body 4, a foam element 6, and a durable fabric cover 8 to protect the foam element. The applicator body 4 may be constructed from any suitable plastic material, such as polypropylene or polyethylene, that can be injection molded or otherwise formed into a desired configuration. The foam element 6 may be embodied as a porous open-cell urethane foam that is compatible with the fluid to be applied. Other types of foam may also be used. The fabric cover 8 may be provided using a porous felt cloth material made from woolen fibers (or other types of fibers) that is capable of receiving fluid from the foam element 6 and expressing it onto a fluid-application surface, and which is suitably resistant to abrasive forces caused by rubbing the fluid applicator 2 back and forth across the intended surface. Other types of porous fabrics (non-woven or woven) may also be used.

Figure 5:
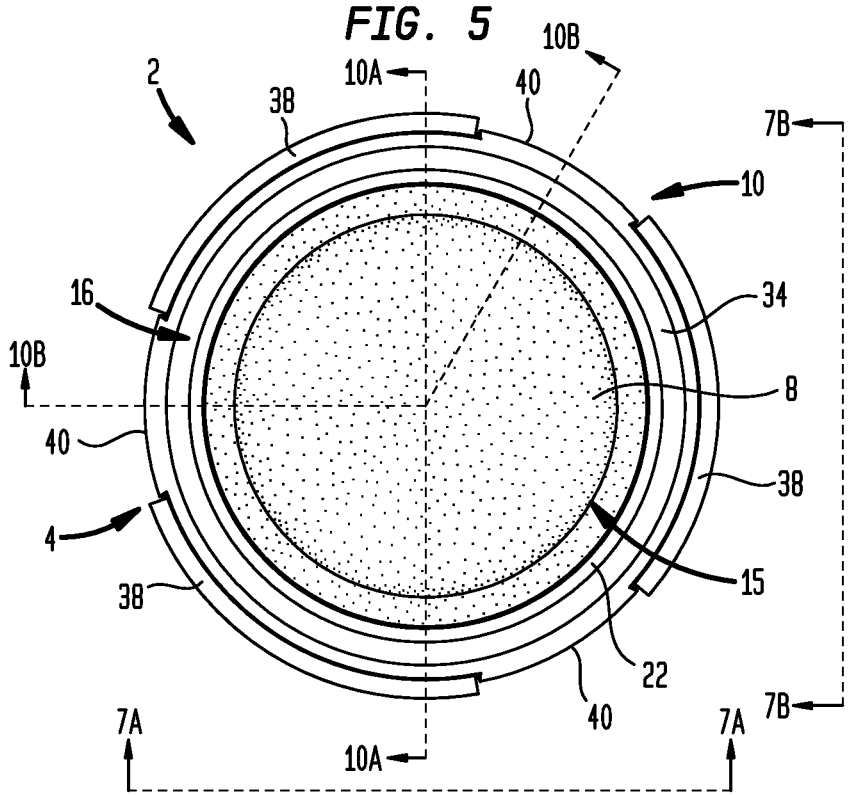
FIG. 5 is a top plan view the fluid applicator of FIG. 1.
Figure 6:
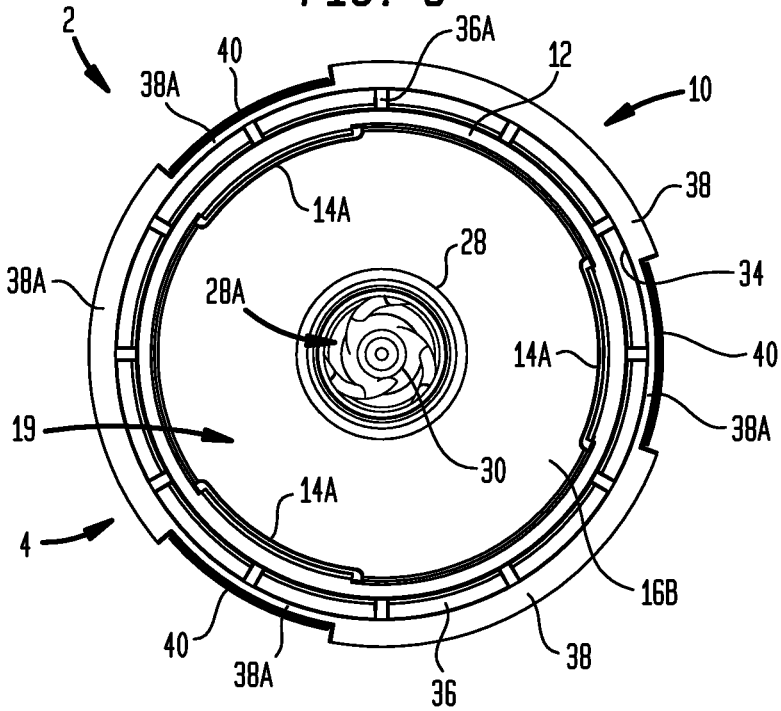
FIG. 6 is bottom plan view of the fluid applicator of FIG. 1.

As best shown in FIGS. 1, 2 and 7A-7B, the applicator body 4 may be formed with a generally button-shaped applicator head 10 and a generally tubular base 12 that extends from the applicator head to an open base end 14 of the applicator body. The exposed fabric-covered side of the applicator head 10 provides a fluid-expelling surface 15 that expresses fluid from the fluid applicator 2 during use. As shown in FIGS. 5 and 6, both the applicator head 10 and the base 12 have a generally circular configuration when seen in plan view orientation. Moreover, as additionally shown in FIG. 3, the foam element 6 is generally disk-shaped and the fabric cover 8 is generally circular. It will be appreciated that non-circular configurations could also be used for these components. For example, the applicator head 10 and/or the base 12 could have an elliptical or other curvilinear plan view configuration, or perhaps a polygonal plan view configuration, such as rectangular, triangular, hexagonal, octagonal, etc.

Figure 4:
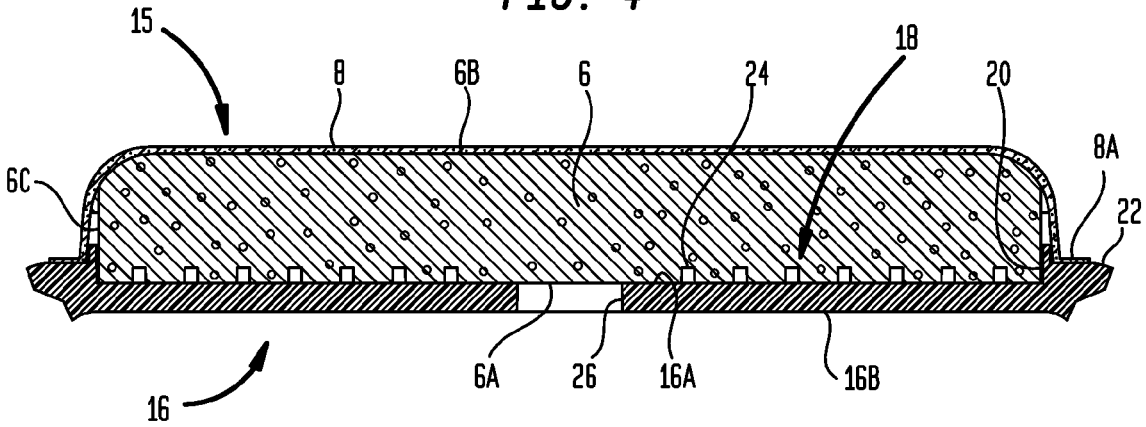
FIG. 4 is a fragmentary cross-sectional view taken along line 4-4 in FIG. 1.

The applicator head 10 provides a foam element support platform 16 having a first outer side 16A (see FIG. 3) and a second inner side 16B (see FIG. 2). As best shown in FIG. 5, the foam element support platform 16 is generally circular when seen in plan view orientation (see FIG. 5). Other configurations could also be used for the foam element support platform 16, depending on the overall shape of the applicator head 10 as well as the shape of the foam element 6 and the fabric cover 8. As shown in FIG. 4, the first and second sides 16A/16B of the foam element support platform 16 are generally planar surfaces that are spaced from one another by a suitable thickness that provides a desired level of structural rigidity. Non-planar surface configurations could also be used. As shown in both FIGS. 3 and 4, the first side 16A of the foam element support platform 16 provides a centrally disposed foam element engaging surface 18. As described in more detail below, the foam element engaging surface 18 may include a friction-enhancing structure to help retain the foam element 6 in position during use of the fluid applicator 2. As shown in FIGS. 2 and 6, the second side 16B of the foam element support platform 16 represents the bottom of a hollow cavity 19 formed by the base 12 of the applicator body 4. As described more detail below, the cavity 19 is sized to receive a fluid container on which the fluid applicator 2 can be mounted.

As best shown in FIGS. 3 and 4, a foam element retaining wall 20 is disposed at a peripheral edge of the foam element engaging surface 18. In the illustrated embodiment, the foam element retaining wall 20 is formed as a continuous, generally circular ring that is generally perpendicular to the first side 16A of the foam element support platform. Non-continuous structures could also be used for the foam element retaining wall 20, such as a set of projections arranged around the peripheral edge of the foam element engaging surface 18. The foam element retaining wall 20 could also be non-circular and/or non-planar, depending on the overall shape of the applicator head 10, the foam element 6 and the fabric cover 8. As shown in FIG. 3, the foam element 6 has a first inner side 6A that is supported on the foam element engaging surface 18, a second outer side 6A opposite the first side, and a peripheral edge 6C. As may be seen in FIG. 4, the foam element's peripheral edge 6C is at least partially enclosed by the foam element retaining wall 20 due to an inner portion of the peripheral edge being covered by the retaining wall. As further shown in FIG. 4, an outer portion of the foam element's peripheral edge 6C may extend beyond the foam element retaining wall 20. In an alternate embodiment (not shown), the entire peripheral edge 6C could be enclosed by the foam element retaining wall 20. In that case, it may be desirable to form the outer side 6B of the foam element 6 as a rounded surface having a central portion that extends beyond the foam element retaining wall 20.

Figure 7A:
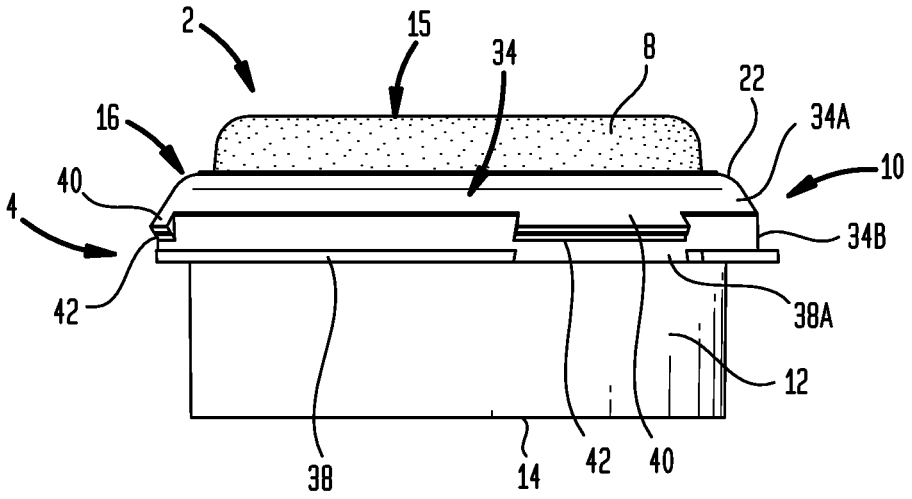
FIG. 7A is a side elevation view of the fluid applicator of FIG. 1 looking in the direction of line 7A-7A in FIG. 5.
Figure 7B:
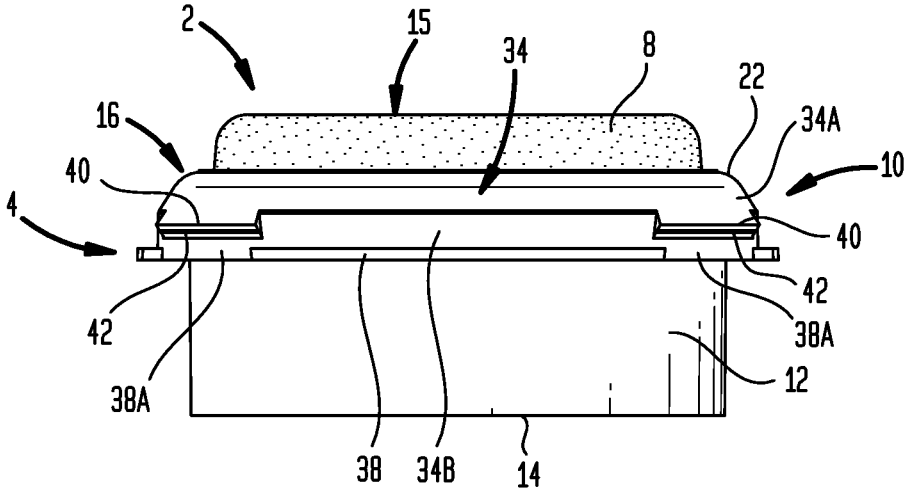
FIG. 7B is a side elevation view of the fluid applicator of FIG. 1 looking in the direction of line 7B-7B in FIG. 5.

As best shown in FIG. 4, a fabric mounting surface 22 is disposed outside the foam element retaining wall 20. In the illustrated embodiment, the foam element retaining wall 20 is a generally planar annular surface (see FIGS. 1, 3 and 5) that surrounds the foam element retaining wall 20 and is arranged in parallel spaced relationship with the first side 16A of the foam element support platform (see FIG. 4). Non-annular and/or non-planar configurations could also be used for the fabric mounting surface 22, depending on the overall shape of the applicator head 10, the foam element 6 and the fabric cover 8. The fabric cover 8 is arranged to cover the second side 6B of the foam element 6, as well as any exposed portion of the foam element's peripheral edge 6C that protrudes beyond the retaining wall 20. An annular periphery 8A of the fabric cover is peripherally bonded to the fabric mounting surface 22 (see FIG. 4) using a suitable bonding operation. During the bonding operation, the periphery 8A of the fabric cover 8 may be pulled downwardly to tighten the fabric cover 8 over the foam element 6. As shown in FIGS. 4 and 7A-7B, this may compress the outside corner of the foam element's peripheral edge 6C, thereby rounding the corner. It will be appreciated that the foam element 6 could also be fabricated with a pre-defined outside corner on the peripheral edge 6C, and/or with a rounded surface on its outer side 6B (as previously mentioned), depending on the desired shape of the fluid-expelling surface 15 of the fluid applicator 2.

The fabric cover's periphery 8A may be bonded to the fabric mounting surface 22 using any suitable type of bond, including but not limited to a bond selected from the group consisting of heat-formed melt bonds, ultrasonic bonds and adhesive bonds. A heat-formed melt bond may be formed by using a mechanical heating device to melt or soften the fabric mounting surface 22 so that it fuses with the fabric cover's periphery 8A. An ultrasonic bond may be formed by ultrasonically melting or softening the fabric mounting surface 22 instead of using a mechanical heating device. An adhesive bond may be formed by applying a suitable adhesive (e.g., glue, hot melt adhesive, etc.) between the fabric mounting surface 22 and the fabric cover's periphery 8A. Advantageously, the use of a bonding technique (regardless of type) to attach the fabric cover's periphery 8A obviates the need for mechanical retainers, such as bands, clips, ties, or other types of fastening elements, devices or systems. As used herein, the terms "bond," "bonded" and "bonding" when describing the attachment of the fabric cover 8 are intended to signify the absence of separate mechanical retainers.

In the illustrated embodiment, the foam element 6 is unbonded to the foam element engaging surface 18, meaning that there is no surface-to-surface connection between these elements. Instead of a bonded interconnection, the foam element 6 is retained on the foam element engaging surface 18 solely by the fabric cover 8, such that these elements are non-interfacially attached to each other. This has the advantage of eliminating a separate foam element bonding operation during fabrication of the fluid applicator 2. Notwithstanding the foregoing, it will be appreciated that foam element bonding (e.g., using a heat-formed melt bond, an ultrasonic bond or an adhesive bonds) could be used if desired. In the illustrated embodiment wherein a separate foam element bonding operation is not used, the foam element engaging surface 18 is provided with a friction-enhancing structure. This structure is formed on the first side 16A of the foam element support platform 16 to help stabilize the foam element 6 against lateral movement. The friction-enhancing structure may be provided in various ways, including by way of one or more raised ridges 24 (see FIGS. 3 and 4). More particularly, the raised ridges 24 may be configured as a set of one or more concentric ring-shaped ridge elements extending outwardly from the first side 16A of the foam element support platform 16. Due to the deformable nature of the foam element 6, the raised ridges 24 protrude into the foam element's inner side 6A (see FIG. 4) to provide superior gripping capability. Each individual raised ridge 24 is shown as having a rectangular cross-sectional shape of selected height and width. Non-rectangular (e.g., triangular) cross-sections could also be used. As an alternative to raised ridges, other friction-enhancing structures, such as a roughened surface configuration, could also be provided on the first side 16A of the foam element support platform. One advantage of using the raised ridges 24 is that they may optionally serve as melt rings if it is desired to provide a heat-formed melt bond or an ultrasonic bond between the foam element 6 and the foam element engaging surface 18.

To further stabilize the foam element 6, the foam element engaging surface 18 may be recessed below the fabric mounting surface 22 and the foam element retaining wall 20 may extend beyond the fabric mounting surface. This configuration, which forms a foam element support well, is achieved by recessing the first side 16A of the foam element support platform 16 below the fabric mounting surface 22, and by selecting the height of the raised ridges 24 so that they do not extend all the way to the plane of the fabric mounting surface. In this way a larger portion of the foam element's peripheral edge 6C will be captured by the foam element retaining wall 20 than if the first side 16A of the foam element support platform 16 was in coplanar relationship with the fabric mounting surface 22.

As further shown in FIG. 4, a fluid port 26 may be formed at the center of the foam element support platform 16 to provide fluid communication between the platform's first and second sides 16A/16B. As shown in FIGS. 2 and 6, a generally tubular retaining structure 28 having a cavity 28A surrounds the fluid port 26 on the second side 16B of the foam element support platform 16. Within the cavity 28A is a fluid release valve 30 of conventional design that blocks fluid from entering the fluid port 26 until the release valve is actuated. The fluid release valve 30 and its operation are described in more detail below.

Figure 9:
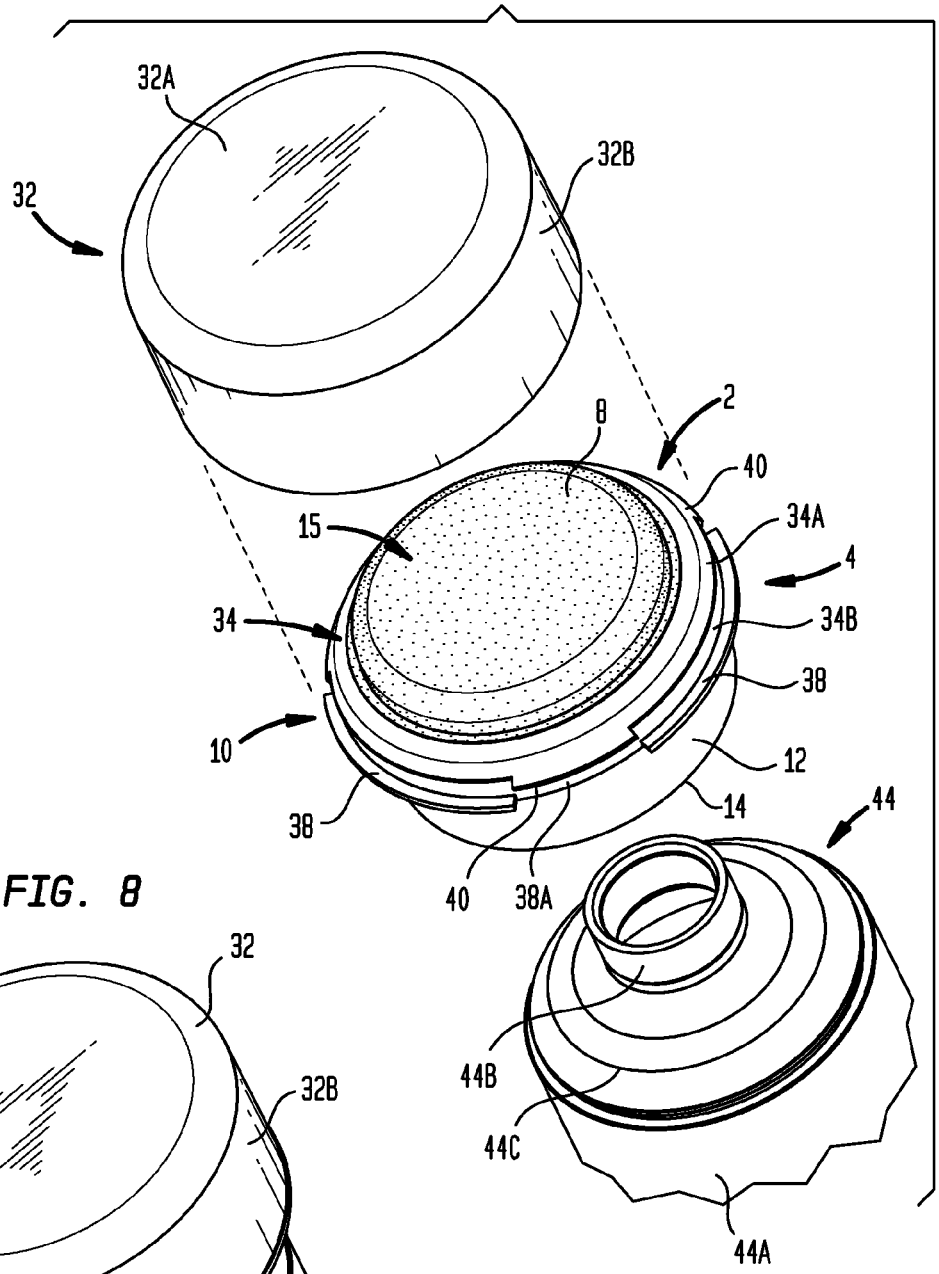
FIG. 9 is an exploded perspective view showing the assembly of FIG. 8.
Figure 8:
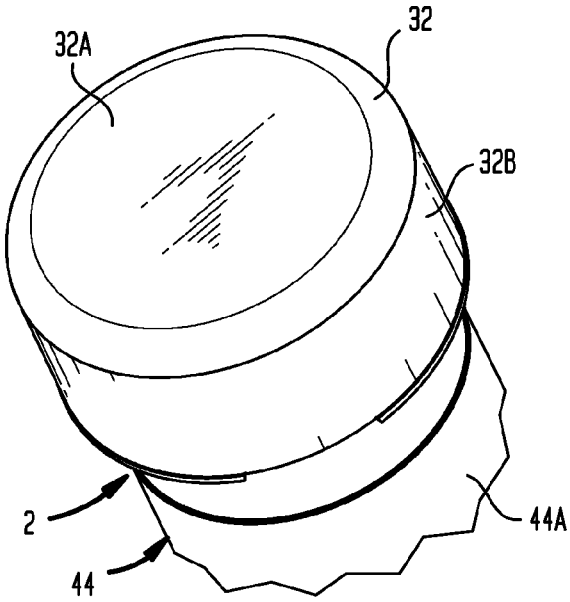
FIG. 8 is a perspective view showing an example assembly comprising the fluid applicator of FIG. 1 mounted on an example fluid container and with the fluid applicator body being covered by an example fluid applicator cap.

Turning now to FIGS. 8 and 9, an applicator cap 32 may be removably placed on the applicator body 4 to cover and protect the fluid-expelling surface 15 when the applicator 2 is not in use. The applicator cap 32 may be formed with a closed base end 32A and a sidewall 32B whose shape conforms to the shape of the applicator head 10. The applicator body 4 is formed with an applicator cap support structure 34 that supports the applicator cap. As can be seen in FIGS. 7A and 7B, and as further shown in FIGS. 10A-10B, the applicator cap support structure 34 includes a first tapered section 34A that tapers radially outwardly and axially away from the fabric mounting surface 22. The applicator cap support structure 34 further includes a second cap-receiving section 34B that is sized to mate with an inside surface 32C of the applicator cap's sidewall 32B. In the illustrated embodiment, the sidewall 32B of the applicator cap 32 is generally tubular and the cap-receiving section 34B of the cap support structure is generally circular. As further shown in FIG. 6, the applicator cap support structure 34 is spaced from the base 12 of the applicator body 4 by an annular gap 36. For increased structural rigidity, a set of radially extending ribs 36A may be provided in the annular gap 36 to interconnect the outside of the base 12 of the applicator body 4 with the inside of the applicator cap support structure 34.

Figure 10A:
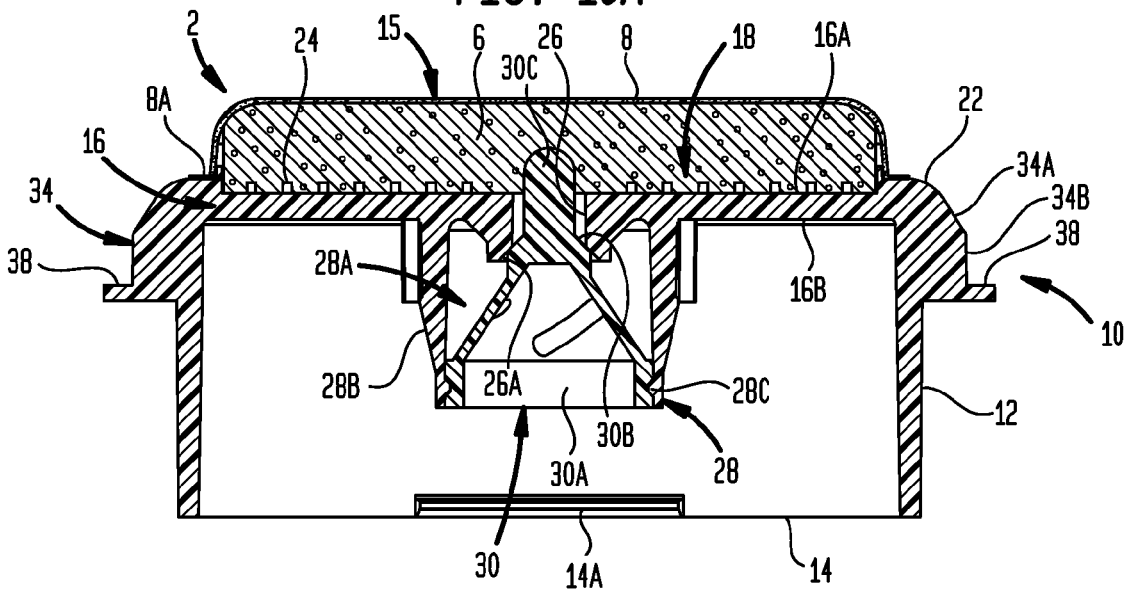
FIG. 10A is a cross-sectional view of the fluid applicator of FIG. 1 taken along line 10A-10A in FIG. 5.
Figure 10B:
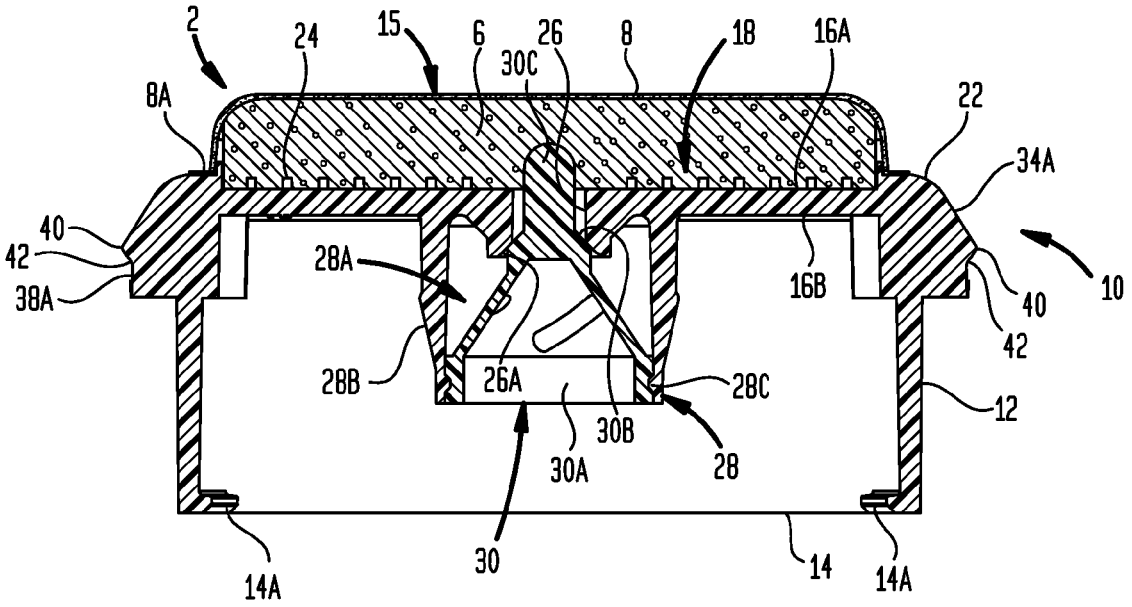
FIG. 10B is a cross-sectional view of the fluid applicator of FIG. 1 taken along line 10B-10B in FIG. 5.
Figure 11:
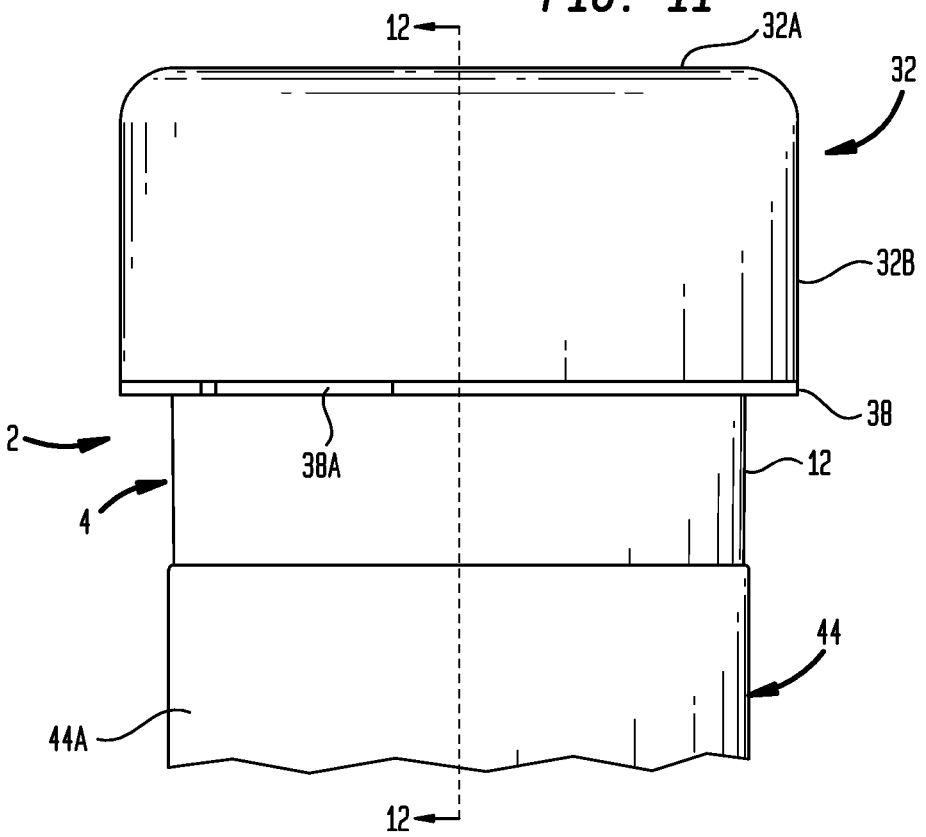
FIG. 11 is a side elevation view of the assembly of FIG. 8.
Figure 12:
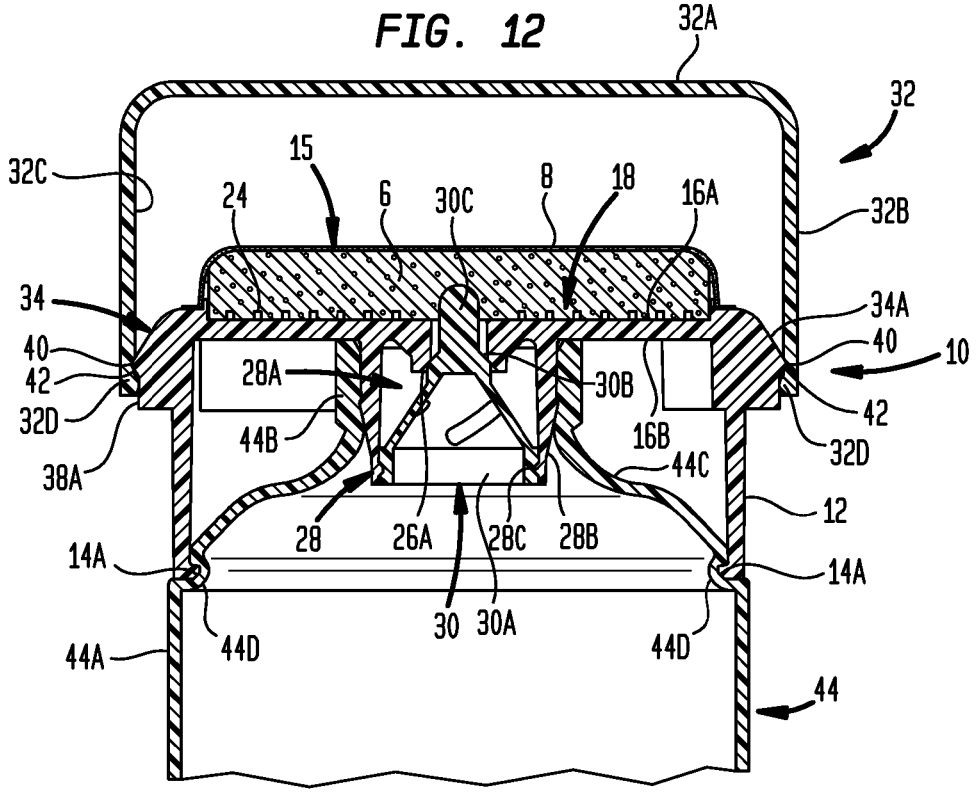
FIG. 12 is a cross-sectional view taken along line 12-12 in FIG. 11.

As can be seen in FIGS. 7A-7B and 9, the applicator cap support structure 34 terminates at a peripheral cap-support ledge 38 that may be of annular (or other) configuration (see FIGS. 5 and 6). The applicator cap support structure 34 additionally includes at one or more radially outwardly extending cap retainer members 40 for retaining the applicator cap 32. Each applicator cap retainer member 40 may be formed as a peripheral bump situated adjacent to the peripheral ledge 38. In the illustrated embodiment, the cap-support ledge 38 is segmented to form several gap spaces 38A, and the applicator cap retainer members 40 are formed in these spaces. As best shown in FIGS. 7A-7B and 10B, the bump configuration of the applicator cap retainer members 40 may be produced by continuing the tapered section 34A of the cap support structure beyond the point where the cap-receiving section 34B would normally begin, then forming an undercut 42 that returns back to the surface of the cap-receiving section. As shown in FIG. 12, the applicator cap 32 may be formed with inwardly extending flanges 32D at locations corresponding to the applicator cap retainer members 40. The flanges 32D are situated at the open end of the applicator cap's sidewall 32B and are configured to engage the undercuts 42. The applicator cap 32 can be made of a suitable plastic so that the sidewall 32B can deform outwardly to engage and release the flanges 32D from the undercuts when the applicator cap is respectively placed on and removed from the applicator body.

As additionally shown in FIGS. 8 and 9, the fluid applicator 2 may be mounted on a fluid container 44 that holds a fluid to be applied to a fluid-application surface. The fluid container 44 is of conventional design and may be configured in a variety of shapes. In FIG. 9, the fluid container 44 is shown as having a generally tubular main body portion 44A, a generally tubular dispensing fluid-dispensing mouth 44B of smaller diameter than the main body portion, and a generally frustoconical tapered neck 44C that interconnects the main body portion and the mouth. As can be seen in FIG. 12, the retaining structure 28 that surrounds the fluid port 26 on the second side 16B of the foam element support platform 16 serves as a first fluid container-engaging structure for engaging the mouth 44B of the fluid container 44. In particular, the retaining structure 28 may be inserted into the mouth 44B and is sized to form a fluid-tight seal therewith. To facilitate such insertion, the retaining structure 28 may be formed with a tapered outer end 28B. Fluid flow from the fluid container 44 to the foam element 6 is controlled by the fluid release valve 30 that is seated within the cavity 28A of the retaining structure 28. The fluid release valve 30 may be conventionally formed as a deformable plastic element having a slotted frustoconical spring portion 30A and a tapered valve element 30B. As shown in FIGS. 10A-10B and 12, the spring portion 30A may be retained within the retaining structure 28 by a circular ring flange 28C formed on the retaining structure's inside wall at the tapered end 28B thereof. As also shown in FIGS. 10A-10B and 12, the valve element 30B seats against a raised, tapered valve seat 26A. The valve seat 26A extends from the second side 16B of the foam element support platform 16, at the entrance to the fluid port 26. As further shown in FIGS. 10A-10B and 12, an actuator pin 30C on the fluid release valve 30 extends through the fluid port 26 and beyond the foam element engaging surface 18 into the foam element 6 itself. When the fluid applicator 2 is pressed against a fluid-application surface with sufficient pressure, the foam element 6 will compressibly deform so that the fluid-application surface pushes the actuator pin 30C to a retracted position while compressing the fluid release valve's spring portion 30A. This actuating movement separates the valve element 30B from the valve seat 26C, allowing fluid to flow from the fluid container 44 into the foam element 6 for delivery.

As further shown in FIGS. 10A-10B and 12, the fluid applicator 2 may additionally include a second fluid container-engaging structure that locks the applicator body 4 onto the fluid container 44. This structure is provided by the base 12 of the applicator body 4 that surrounds the retaining structure 28 on the second side 16B of the foam element support platform 16. In particular, one or more latch members 14A (three are shown) may be formed at the open base end 14 of the applicator body 4 to lockingly engage the fluid container 44. As additionally shown in FIGS. 2 and 6, the latch members 14A may be formed as radially-inwardly-extending flanges. As can be seen in FIG. 12, these flanges are received in, and lockingly engage to, corresponding cavities 44D that are formed at the transition between the fluid container's main body portion 44A and its tapered neck 44C.

To use the fluid applicator 2, the applicator cap 32 is removed from the applicator body 4 to expose the fluid-expelling surface 15 on the applicator head 10. While holding the main body portion 44A of the fluid container 44 (or while holding the applicator body 4), the fluid applicator 2 is manipulated so that the fluid-expelling surface 15 is brought into contact with the fluid-application surface on which fluid is to be applied. By applying sufficient pressure to retract the actuator pin 30C, the fluid release valve 30B will open the fluid port 26 to provide a fluid pathway from the interior of the fluid container 44 to the foam element 6. Fluid can be made flow along this fluid pathway into the foam element 6 using a gravity feed technique by inverting the fluid applicator 2 so that the fluid-expelling surface 15 is below the fluid container 44. Alternatively, if the fluid container's main body portion 44A is flexible, fluid flow may be induced by squeezing the main body portion to force fluid into the foam element 6. As the fluid flows through the fluid port 26, it will enter the foam element 6 and become dispersed therein. When the fluid reaches the fabric cover 8, it will transfer through the fabric material and will be expressed from fluid-expelling surface 15 onto the fluid-application surface. The fluid applicator 2 may then be moved over the fluid-application surface to apply the fluid to a desired area. Once a sufficient amount of fluid has been applied, the fluid applicator 2 can be withdrawn to remove the fluid-expelling surface 15 thereof from the fluid-application surface. This will release the retraction pressure on the actuator pin 30C, causing the fluid release valve 30B to close under the force of the fluid release valve's spring portion 30A. The applicator cap 32 may then be placed back on the applicator body 4 to cover and protect the fluid-expelling surface 15 during periods of non-use of the fluid applicator 2.

Accordingly, a fluid applicator has been disclosed that is particularly suited to applying a fluid to irregular, rough or abrasive surfaces. Although an example embodiment has been shown and described, it should be apparent that many variations and alternative embodiments could be implemented in accordance with the present disclosure. It is understood, therefore, that the invention is not to be in any way limited except in accordance with the spirit of the appended claims and their equivalents.

What is claimed is:

1. A fluid applicator, comprising:

an applicator body;

a foam element support platform on said body, said foam element support platform having a first side and a second side;

a foam element engaging surface on said first side of said foam element support platform;

a foam element retaining wall disposed at a peripheral edge of said foam element engaging surface;

a foam element having a first side supported on said foam element engaging surface, a second side opposite said first side, and a peripheral edge at least partially enclosed by said foam element retaining wall;

a fabric mounting surface disposed outside of said foam element retaining wall;

a fabric cover arranged to cover said second side of said foam element and being peripherally bonded to said fabric mounting surface; and a fluid port in said foam element support platform providing fluid communication between said first side and said second side of said foam element support platform.

2. The fluid applicator of claim 1, wherein said foam element is unbonded to said foam element engaging surface and is retained thereon solely by said fabric covering.

3. The fluid applicator of claim 1, wherein said fabric cover is bonded to said fabric mounting surface by a bond selected from the group consisting of heat-formed melt bonds, ultrasonic bonds and adhesive bonds.

4. The fluid applicator of claim 1, wherein said foam element engaging surface comprises a raised friction-enhancing structure to help stabilize said foam element against lateral movement.

5. The fluid applicator of claim 4, wherein said friction-enhancing structure comprises raised ridges.

6. The fluid applicator of claim 1, wherein said foam element engaging surface is recessed below said fabric mounting surface and said foam element retaining wall extends beyond said fabric mounting surface.

7. The fluid applicator of claim 1, wherein said foam element engaging surface comprises a circular area centrally disposed on said foam element support platform, said foam element retaining wall comprises a ring-shaped structure surrounding said foam element engaging surface, and said fabric mounting surface comprises an annular surface surrounding said foam element retaining wall.

8. The fluid applicator of claim 1, wherein said applicator further comprises an applicator cap on said applicator body.

9. The fluid applicator of claim 8, wherein said applicator body comprises an applicator cap support structure that supports said applicator cap, and said applicator body further comprises one or more applicator cap retainer members that retain said applicator cap.

10. The fluid applicator of claim 9, wherein said applicator cap support structure comprises a peripheral ledge, and each of said one or more applicator cap retainer members comprises a peripheral bump extending from said medial portion adjacent to said peripheral ledge.

11. The fluid applicator of claim 10, wherein said peripheral ledge is segmented to provide one or more gap spaces in which said one or more applicator cap retainer members are respectively disposed.

12. The fluid applicator of claim 10, further including a first fluid container-engaging structure surrounding said fluid port on said second side of said foam element support platform.

13. The fluid applicator of claim 12, further including a fluid release valve disposed in said first fluid container-engaging structure.

14. The fluid applicator of claim 12, further including a second fluid container-engaging structure surrounding said first fluid container-engaging structure on said second side of said foam element support platform.

15. The fluid applicator of claim 14, wherein said second fluid container-engaging structure comprises one or more latch members operable to lockingly engage a fluid container.

16. A fluid applicator, comprising:

an applicator body;

a foam element support platform on said body, said foam element support platform having a first side and a second side;

a foam element engaging surface on said first side of said foam element support platform;

a foam element retaining wall disposed at a peripheral edge of said foam element engaging surface;

a foam element having a first side supported on said foam element engaging surface, a second side opposite said first side, and a peripheral edge at least partially enclosed by said foam element retaining wall;

a fabric mounting surface disposed outside of said foam element retaining wall;

a fabric cover arranged to cover said second side of said foam element and being peripherally bonded to said fabric mounting surface;

a fluid port in said foam element support platform providing fluid communication between said first side and said second side of said foam element support platform;

said foam element being unbonded to said foam element engaging surface and retained thereon solely by said fabric covering; and said foam element engaging surface comprising a raised friction-enhancing structure to help stabilize said foam element against lateral movement.

17. The fluid applicator of claim 16, wherein said friction-enhancing structure comprises a set of raised ridges.

18. The fluid applicator of claim 16, wherein said foam element engaging surface is recessed below said fabric mounting surface and said foam element retaining wall extends beyond said fabric mounting surface.

19. The fluid applicator of claim 16, wherein said foam element engaging surface comprises a circular area centrally disposed on said foam element support platform, said foam element retaining wall comprises a ring-shaped structure surrounding said foam element engaging surface, and said fabric mounting surface comprises an annular surface surrounding said foam element retaining wall.

20. A fluid applicator, comprising:

an applicator body having a generally button-shaped applicator head and a generally tubular base extending from said applicator head to an open base end of said applicator body;

said applicator head comprising a foam element support platform having a generally planar outer first side and generally planar inner second side from which said tubular base of said applicator body extends;

a generally circular foam element engaging surface on said first side of said foam element support platform;

a generally ring-shaped foam element retaining wall disposed at a peripheral edge of said foam element engaging surface;

a generally disk-shaped foam element having a inner first side supported on said foam element engaging surface, an outer second side opposite said first side, and a generally circular peripheral edge having an inner portion that is enclosed by said foam element retaining wall;

a generally annular fabric mounting surface surrounding said foam element retaining wall, said fabric mounting surface being generally parallel to and spaced from said first side of said foam element support platform to form a foam element support well;

a generally circular fabric cover arranged to cover said second side of said foam element and an outer portion of said foam element peripheral edge, and being peripherally bonded to said fabric mounting surface;

a generally tubular first fluid container-engaging structure centrally disposed on said second side of said foam element support platform and comprising a configuration that allows insertion thereof into a fluid-dispensing mouth of a fluid container;

a fluid port within said first fluid container-engaging structure providing fluid communication through said foam element support platform;

a fluid release valve in said first fluid container-engaging structure operable to releasably close said fluid port;

a generally tubular second fluid container-engaging structure provided by said base of said applicator body, said second fluid container-engaging structure comprising a configuration at said base end of said applicator body that provides one or more latch members for engaging a main body portion of said fluid container;

an applicator cap support structure extending radially outwardly and axially away from said fabric mounting surface to form an annular ring surrounding said base of said applicator body in spaced relationship therewith;

said applicator cap support structure terminating at a generally annular cap-support ledge; and said applicator cap support structure further comprising at least one radially outwardly extending cap-retaining bump adjacent to said cap-support ledge.

* * * * *